US011835326B2

(12) United States Patent
Cegiel et al.

(10) Patent No.: US 11,835,326 B2
(45) Date of Patent: Dec. 5, 2023

(54) IGNITER WITH A DELAY TIME THAT CAN BE SET

(71) Applicant: Rheinmetall Waffe Munition GmbH, Unterlüß (DE)

(72) Inventors: Dirk Cegiel, Trittau (DE); Ernest Schulz, Hamburg (DE); Julia Strenger, Hamburg (DE); Frank Habel, Hohnstorf (DE)

(73) Assignee: Rheinmetall Waffe Munition GmbH, Unterlüß (DE)

( * ) Notice: Subject to any disclaimer, the term of this patent is extended or adjusted under 35 U.S.C. 154(b) by 413 days.

(21) Appl. No.: 17/283,288

(22) PCT Filed: Oct. 7, 2019

(86) PCT No.: PCT/EP2019/077102
§ 371 (c)(1),
(2) Date: Apr. 7, 2021

(87) PCT Pub. No.: WO2020/074452
PCT Pub. Date: Apr. 16, 2020

(65) Prior Publication Data

US 2021/0389105 A1 Dec. 16, 2021

(30) Foreign Application Priority Data

Oct. 8, 2018 (DE) ..... 10 2018 124 363.4

(51) Int. Cl.
*F42B 3/16* (2006.01)
*F42C 9/10* (2006.01)
*F42C 14/02* (2006.01)

(52) U.S. Cl.
CPC ..... *F42B 3/16* (2013.01); *F42C 9/10* (2013.01); *F42C 14/02* (2013.01)

(58) Field of Classification Search
CPC ..... F42B 3/16; F42C 9/10; F42C 14/02
(Continued)

(56) References Cited

U.S. PATENT DOCUMENTS 3,439,614 A * 4/1969 Schnepfe, Jr. ..... F42C 9/10 102/482
3,830,158 A * 8/1974 Di Phillipo ..... F02K 9/95 102/277.2

(Continued)

FOREIGN PATENT DOCUMENTS

AT 403 410 B 2/1998
DE 1 956 872 A1 6/1970

(Continued)

OTHER PUBLICATIONS

Office Action from corresponding Canadian Patent Application No. 3112896, dated Sep. 22, 2022.

(Continued)

*Primary Examiner* — Samir Abdosh
(74) *Attorney, Agent, or Firm* — Harness, Dickey & Pierce, P.L.C.

(57) ABSTRACT

The invention relates to an igniter with a delay time (Vz) that can be set. The delay time (Vz) can be fixedly defined, or individually and situation-dependently set on-site. In particular, the invention relates to a delay time that can be set for a stun grenade, a hand grenade etc., with options for the individual setting and situation-dependent or situation-contingent customisation of the delay time (Vz), and consequently of the effect of the active compositions in-situ. In order to achieve individual setting options, the invention proposes that at least two different delay times (Vz) can be set. To this end, the igniter has, in a delay section, preferably in the fuse head, a relief bore that can be closed or opened.

11 Claims, 1 Drawing Sheet

(58) Field of Classification Search
USPC ..... 102/200
See application file for complete search history.

(56) References Cited

U.S. PATENT DOCUMENTS

| | | | | |
|---|---|---|---|---|
| 9,329,010 | B1 * | 5/2016 | Moy | F42B 39/20 |
| 2009/0235838 | A1 * | 9/2009 | Hultman | F42C 9/142 102/293 |

FOREIGN PATENT DOCUMENTS

| | | | |
|---|---|---|---|
| DE | 10 2012 014 150 | A1 | 1/2014 |
| WO | WO-2009151702 | A1 | 12/2009 |
| WO | WO-2018197330 | A1 | 11/2018 |

OTHER PUBLICATIONS

Examiner's Report from corresponding Canadian Patent Application No. 3,112,896, dated Mar. 15, 2023.
International Search Report from corresponding PCT Application No. PCT/EP2019/077102, dated Dec. 9, 2019.

* cited by examiner

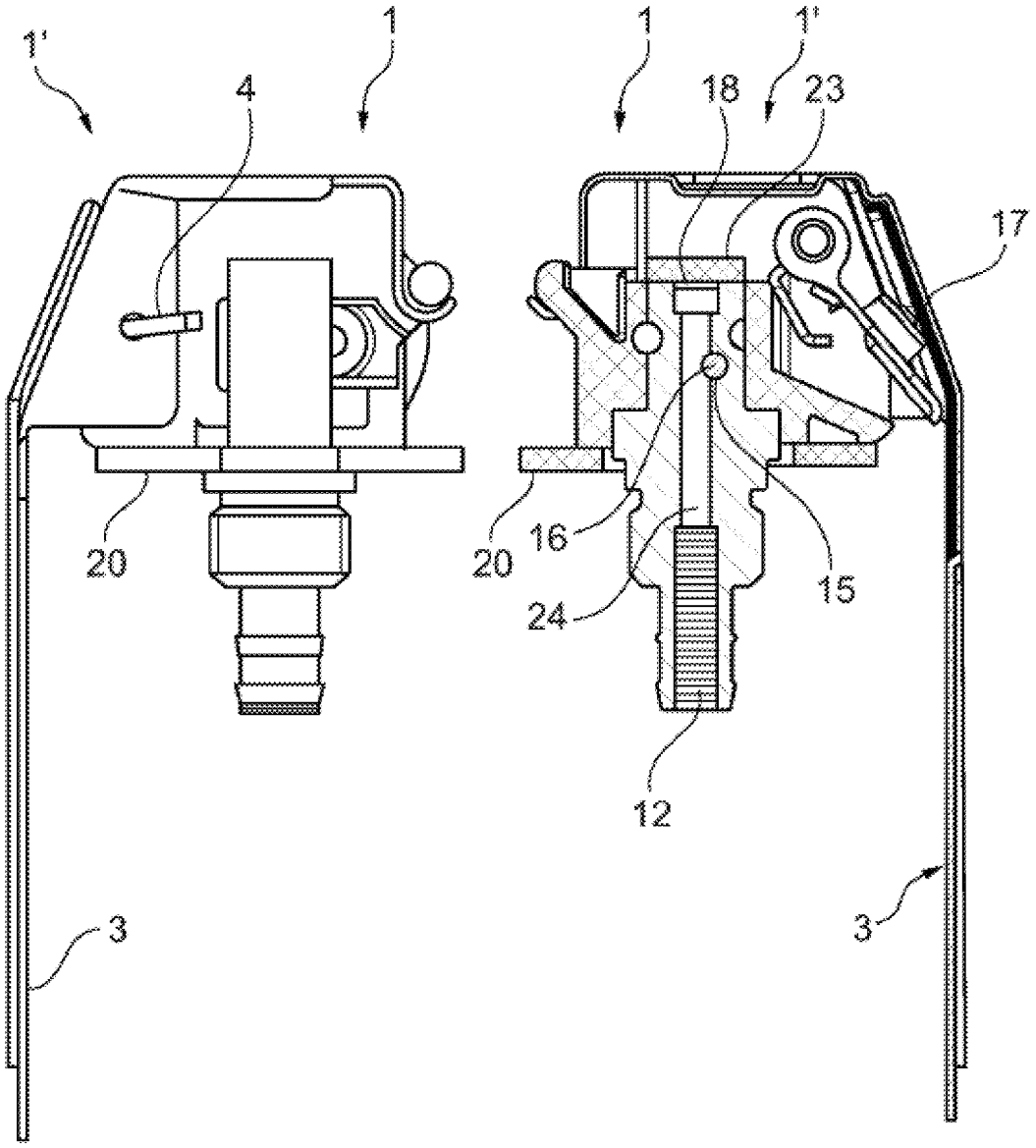
1'
1
4
20
3
1
1'
18
23
17
20
16
24
15
12
3

IGNITER WITH A DELAY TIME THAT CAN BE SET

CROSS-REFERENCE TO RELATED APPLICATIONS

This application is a national phase application of PCT Application No. PCT/EP2019/077102, filed on 7 Oct. 2019, which claims benefit of German Patent Application No. 10 2018 124 363.4, filed on 8 Oct. 2018. The entire disclosures of the applications identified in this paragraph are incorporated herein by references.

FIELD

The invention relates to an igniter with an adjustable delay time. The delay time can be fixed or set individually and depending on the situation in the field. In particular, the invention relates to an adjustable delay time for an irritation body, a hand grenade etc. with the possibility of an individual setting and situation-dependent or situation-related adjustment of the delay time, and thus the effect of the active material in the field. The scope of the active material includes, among other things, bangs, flashes, noises (for example whistle signals) etc., i.e. so-called shock effects, as well as explosives.

BACKGROUND

Irritation bodies of this kind are used for non-lethal defense and defense against persons and are also used for support in police operations. They resemble hand grenades, which are usually ignited manually and then thrown, but should not form fragments. Hand grenades often have a lethal background image.

DE 199 44 486 C2 discloses an irritation body for manual ignition and throwing with a cylindrical container, which has several compartments running parallel to the central axis of the container, which can accommodate effect charges. The ignition of the effect charges is carried out with a manually actuated ignition device on one side of the cylindrical container. After ignition, all effect charges in the container are fired sequentially in chronological order, i.e., time-shifted, ignited and fired radially outwards. DE 92 13 375 U1 which is cited in this document describes an irritation body which provides charge containers for accommodating the respective delay charge and effect charge for delay times in the compartments. These effect charges are then ignited sequentially by these delay charges with different delay times.

SUMMARY

The invention has the object of revealing a possible way in which adaptation of the delay or delay time can be achieved, in particular in the field.

The object is achieved by the features of claim 1. Advantageous embodiments are revealed in the subordinate claims.

The invention is based on the idea that setting the delay time (Vz) is provided so that the delay charge or the delay set burns normally or for an extended period. This idea is based on the knowledge that a pyrotechnical charge burning under no pressure burns down more slowly than a charge under pressure.

A pyrotechnic delay charge with a burning rate of a maximum of 5 mm/sec is known from DE 19 56 872 A1. This delay charge is used in a delay element in the second range, with a sleeve in which a firing charge and a firing device are also arranged. The delay charge has a firing bore. Together with the sleeve, the firing charge and the delay charge with the firing bore form a pyrotechnic delay element. The firing bore is functionally connected to an ejection charge via another bore in the base and another bore in the headpiece.

DE 10 2012 014 150 A1 reveals a delay element for ammunition. This consists of a tube, a sleeve, a preload, and a chemical delay charge inserted into the tube. The tube has an axial slot over a part of its length and is mounted axially movably in the sleeve. A narrow annular surface of the sleeve covers the end of the slot on the firing side, so that the ignition charge does not come into contact with the delay charge in the slot of the tube. This position means the exploitation of the maximum delay time.

According to the present invention, on the other hand, a so-called relief bore is provided, which can set a pressureless state in the ignition housing. This relief bore is therefore preferably provided in the ignition housing. Closing the relief bore can be carried out in a simplest variant with a means such as a pin, a split pin or the like in the relief bore, which can be removed from the relief bore to open it.

The invention relates to an igniter with an adjustable delay time. The delay time may be fixed or set in the field individually and depending on the situation. In particular, the invention relates to an adjustable delay time for an irritation body, a hand grenade etc. with the possibility of an individual setting capability and situation-dependent or situation-related adjustment of the delay time and thus of the effect of the active material in the field.

In the case of an igniter of an irritation body, the opening of the relief bore, if this located in the igniter housing or the igniter head, can also be carried out by a slight displacement of the igniter head upwards relative to the housing (igniter housing). This allows the combustion gases to escape from the delay line (Vz line).

When choosing a means, such as a pin, it is considered that this can be pulled or pressed to release the relief bore. Twisting a contour pin as a means is another of many possible ways to open or close the relief bore. However, the proposed possible ways should be designed in such a way that the relief bore can also be closed again by the means.

The adjustable Vz time can be easily and preferably implemented in two freely selectable variants. Here one can set delay times of, for example, 0.5 s or 1.0 s, 1.0 s or 1.5 s, etc. There are other possibilities.

Therefore, the possibility is proposed of an individual adjustment option and situation-dependent or situation-related adjustment of the delay time Vz. This then has, for example, an influence on the effect of active material in the field. The adjustment possibility is realized in that two different delay times Vz can be set by means of a relief bore. In the case of an irritation body or a hand grenade, a relief bore in the delay line is preferably provided in the igniter head, which can be closed or opened.

BRIEF DESCRIPTION OF THE DRAWINGS

The invention will be explained in more detail on the basis of an exemplary embodiment with a drawing.

FIG. 1 shows a representation of an igniter 1, here an igniter head, of a known irritation body which is not shown in detail. This FIGURE shows the igniter head 1' in a representation in which a rocker lever 3 is on the left on the igniter head 1' as well as in a sectional representation in which the rocker lever 3 is to the right of this. The rocker lever 3 is secured by a split pin 4 in a known manner and keeps a spring-loaded firing pin 17 or striker/igniter (a detonator), i.e. an object with explosives, from striking a percussion cap 18.

DETAILED DESCRIPTION

As can be seen from the FIGURE in the representation on the right, the igniter head 1' has a relief bore 15 in a delay line 24, which can be released by another split pin, a pin 16 or the like.

The relief bore 15 is located in the delay line 24 (channel) and this is preferably within the igniter head 1'.

The operation is as follows:

The irritation body is protected by the safety catches 20. The safety catch 20 is pressed into the gap 22, for example during assembly. In addition, this safety catch 20 prevents the detonator 17 from unintentionally striking the ignition cap 18 by the flap 23 protruding into the igniter head 1'. This further safety catch 20 is only removed immediately before use. It therefore also prevents any manipulation of the Vz adjustment and the split pin 4 (for example a rotary split pin). Only after removing the safety catch 20 does a pressure safety catch, which is not shown in detail, disengage and release the split pin 4.

For setting the delay time Vz, the split pin 16 can remain in the relief bore 15 or can be pulled out of it. When the relief bore 15 is opened, the pyrotechnic delay charge 12 burns without pressure and thus slower than under pressure. This is achieved by a longer Vz compared to a closed relief bore 15. If, on the other hand, the relief bore 15 remains closed, the burning of the pyrotechnic delay charge 12 takes place as originally set by means of the quantity of the delay charge, i.e. normally.

This exemplary embodiment refers to an irritation body above. However, the application of the inventive idea of the simple setting of the delay time is not limited to this use. An application with a hand grenade is also conceivable.

What is claimed is:

1. An igniter with an adjustable delay time, wherein a relief bore is provided in a delay line of a delay charge and wherein the relief bore is configured to be opened or closed by a pin.

2. The igniter as claimed in claim 1, wherein the pin includes a split pin.

3. The igniter as claimed in claim 1, wherein the pin is configured to be pulled, pressed, or twisted.

4. The igniter as claimed in claim 1, wherein the delay time is adjustable between a first set delay time and a second set delay time.

5. The igniter as claimed in claim 4, wherein the delay time is adjustable between at least one of the following: 0.5 seconds and 1.0 second, 1 second and 1.5 seconds, and 1.5 seconds and 2 seconds.

6. An irritation body comprising the igniter as claimed in claim 1.

7. The irritation body as claimed in claim 6, further comprising an igniter head, wherein the relief bore is inserted in the igniter head.

8. The irritation body as claimed in claim 7, further comprising a housing, wherein an opening of the relief bore is realized by a slight movement of the igniter head upwards relative to the housing.

9. The irritation body as claimed in claim 6, further comprising a safety catch configured to prevent manipulation of the adjustable delay time and the pin.

10. A hand grenade comprising the igniter as claimed in claim 1.

11. The hand grenade as claimed in claim 10, further comprising an igniter head, wherein the relief bore is inserted in the igniter head.

* * * * *